US006012731A

United States Patent [19]

Liu

[11] Patent Number: 6,012,731

[45] Date of Patent: Jan. 11, 2000

[54] BABY WALKER

[76] Inventor: Yuan-Mean Liu, 2F., No. 34, Lane 200, Tung Hwa Street, Taipei, Taiwan

[21] Appl. No.: 09/276,135

[22] Filed: Mar. 25, 1999

[51] Int. Cl.[7] ..... B62B 9/12

[52] U.S. Cl. ..... 280/87.051

[58] Field of Search ..... 280/87.051, 87.041, 280/87.021; 16/18 R; 297/136

[56] References Cited

U.S. PATENT DOCUMENTS 5,056,776 10/1991 Cheng ..... 280/87.051

5,662,344 9/1997 Lu ..... 280/87.051

5,813,720 9/1998 Huang ..... 280/87.051

*Primary Examiner*—Richard M. Camby

*Attorney, Agent, or Firm*—Varndell & Varndell, PLLC

[57] ABSTRACT

A baby walker, which includes a wheeled base, a fixed seat holder supported on the wheeled base, a rotary carrier supported on the seat holder to hold a seat, and a ball bearing mounted on the seat holder to support the seat holder, for enabling the rotary carrier and the seat to be rotated on the seat holder, and a latch moved to lock/unlock the rotary carrier.

5 Claims, 8 Drawing Sheets

BABY WALKER

BACKGROUND AND SUMMARY OF THE INVENTION

The present invention relates to a baby walker, and particularly to such a baby walker which comprises a fixed seat holder supported on a wheeled base, and a rotary carrier rotatably supported on the seat holder to hold a seat.

A regular baby walker, as shown in FIG. 1, is generally comprised of a fixed seat holder supported on a wheeled base to hold a seat. The seat holder has a plurality of plug holes for the positioning of the seat. The seat has a plurality of mounting pins respectively fastened to the plug holes at the seat holder. When installed, the seat can not be rotated on the seat holder.

According to one aspect of the present invention, the baby walker comprises a wheeled base, a fixed seat holder supported on the wheeled base, a rotary carrier supported on the seat holder to hold a seat, and a ball bearing mounted on the seat holder to support the seat holder, for enabling the rotary carrier and the seat to be rotated on the seat holder. According to another aspect of the present invention, a latch is provided at the seat holder, and moved to lock/unlock the rotary carrier. According to still another aspect of the present invention, the seat holder has a plurality of pin holes for the positioning of the seat after removal of the rotary carrier and the ball bearing from the seat holder. According to still another aspect of the present invention, the wheeled base is equipped with a folding collapsible stand, that can be extended out to support the baby walker on the floor positively.

DETAILED DESCRIPTION OF THE PREFERRED EMBODIMENT

Figure 1:
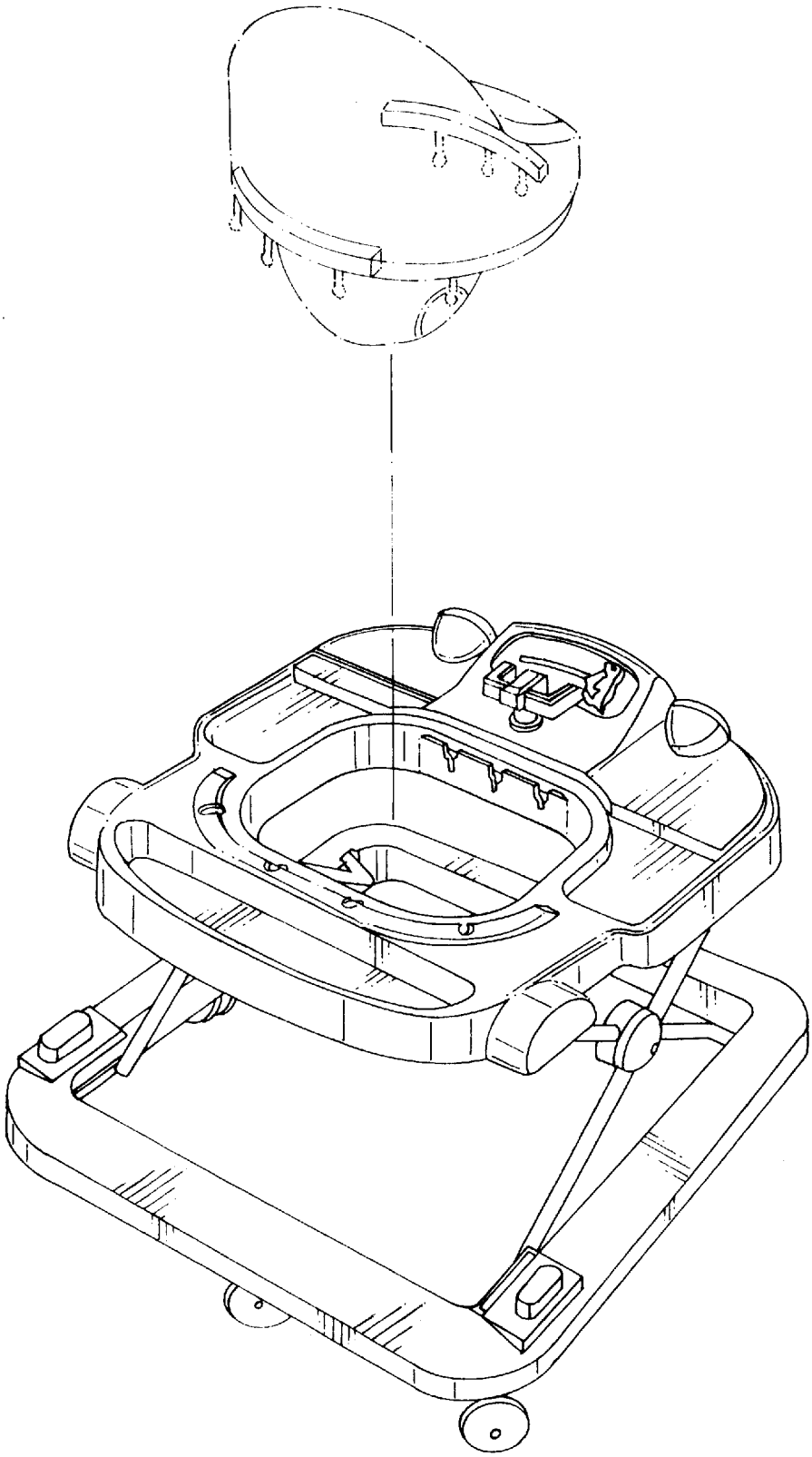
Fig. 1 PRIOR ART
FIG. 1 is a perspective view of a baby walker according to the prior art.

Referring to Figures from 2 through 8, a baby walker 1 comprises a seat holder 2 supported on a wheeled base 5, a ball bearing 4 mounted on the seat holder 2, a rotary carrier 3 supported on the ball bearing 4, and a seat 10 supported on the rotary carrier 3.

Figure 4:
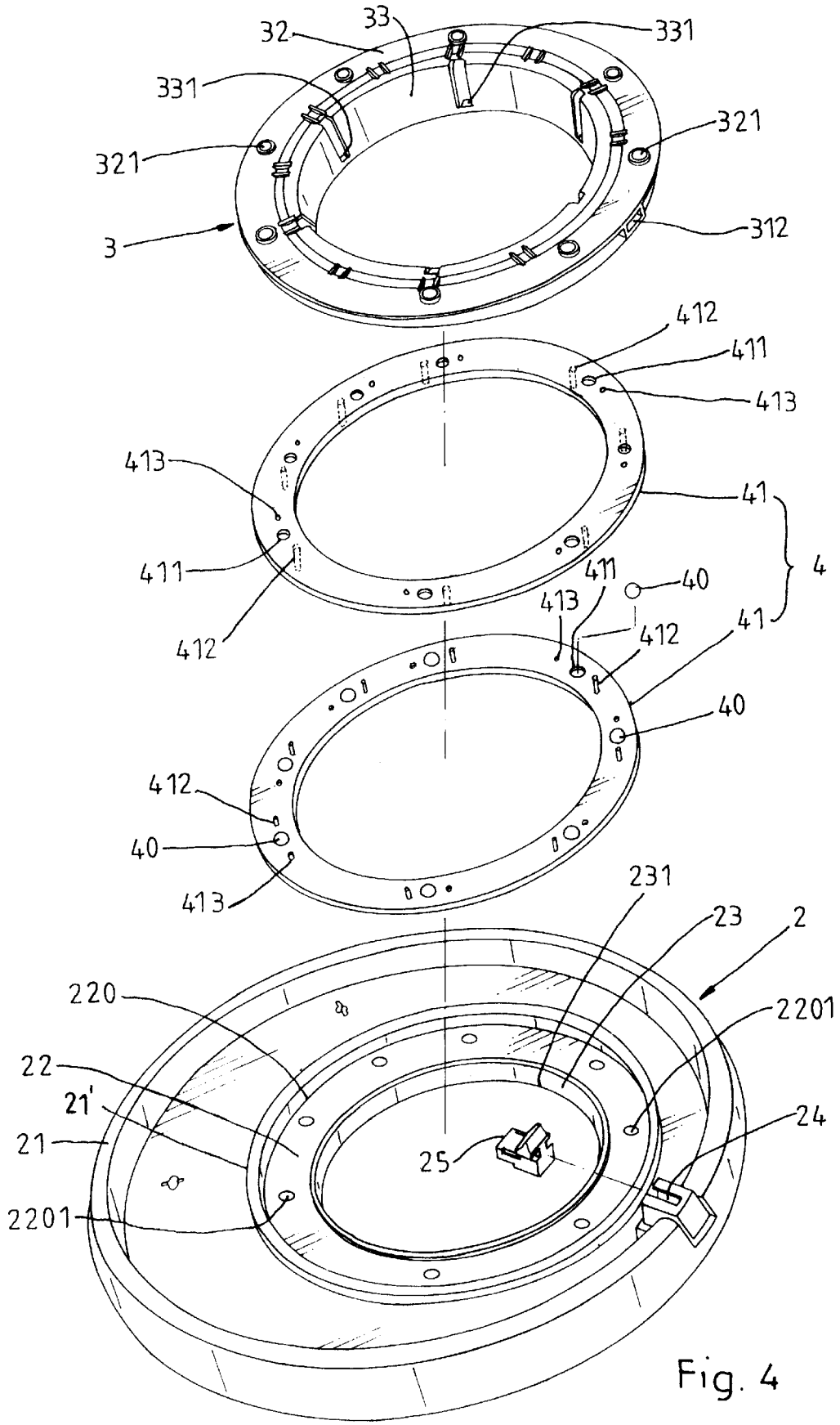
FIG. 4 is an exploded view in an enlarged scale of a part of the present invention.
Figure 5:
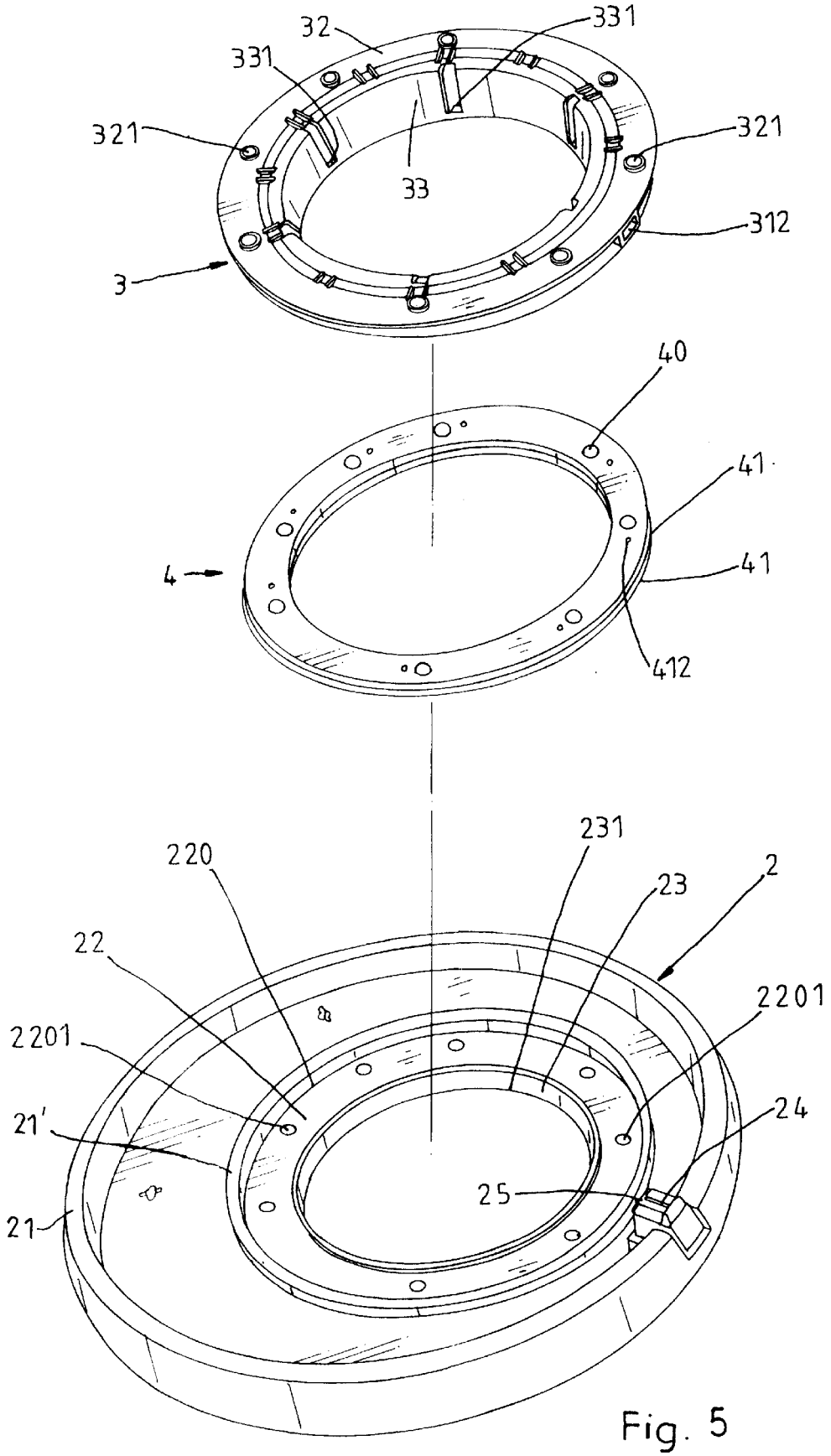
FIG. 5 is similar to FIG. 4 but showing the ball bearing assembled.

The seat holder 2, as shown in FIGS. 4 and 5, comprises an inner flange 23 around the inner diameter thereof, two endless upright flanges 21 and 21' concentrically raised from the top side wall 22 thereof around the inner flange 23, a top annular groove 220 defined between the inner flange 23 and the inner endless upright flange 21', a plurality of pin holes 2201 equiangularly spaced in the top annular groove 220 through the top side wall 22, a latch holder 24 provided inside the-outer endless upright flange 21, and a latch 25 moved in and out of the latch holder 24.

The ball bearing 4, as show in FIGS. 4 and 5, is mounted within the annular groove 220 at the seat holder 2, comprised of two annular races 41 connected in parallel, and a plurality of steel balls 40 retained between the annular races 41. The races 41 each comprise a plurality of equiangularly spaced ball holes 411 of diameter smaller than the steel balls 40 for receiving the steel balls 40, a plurality of equiangularly locating pins 412, and a plurality of equiangularly spaced pin holes 413. By plugging the locating pins 412 at one race 41 into the pin holes 413 at another, the races 41 are connected together to hold the steel balls 40 in the ball holes 411 between the races 41. When assembled, the steel balls 40 peripherally project out of the ball holes 411 at the races 41.

Figure 8:
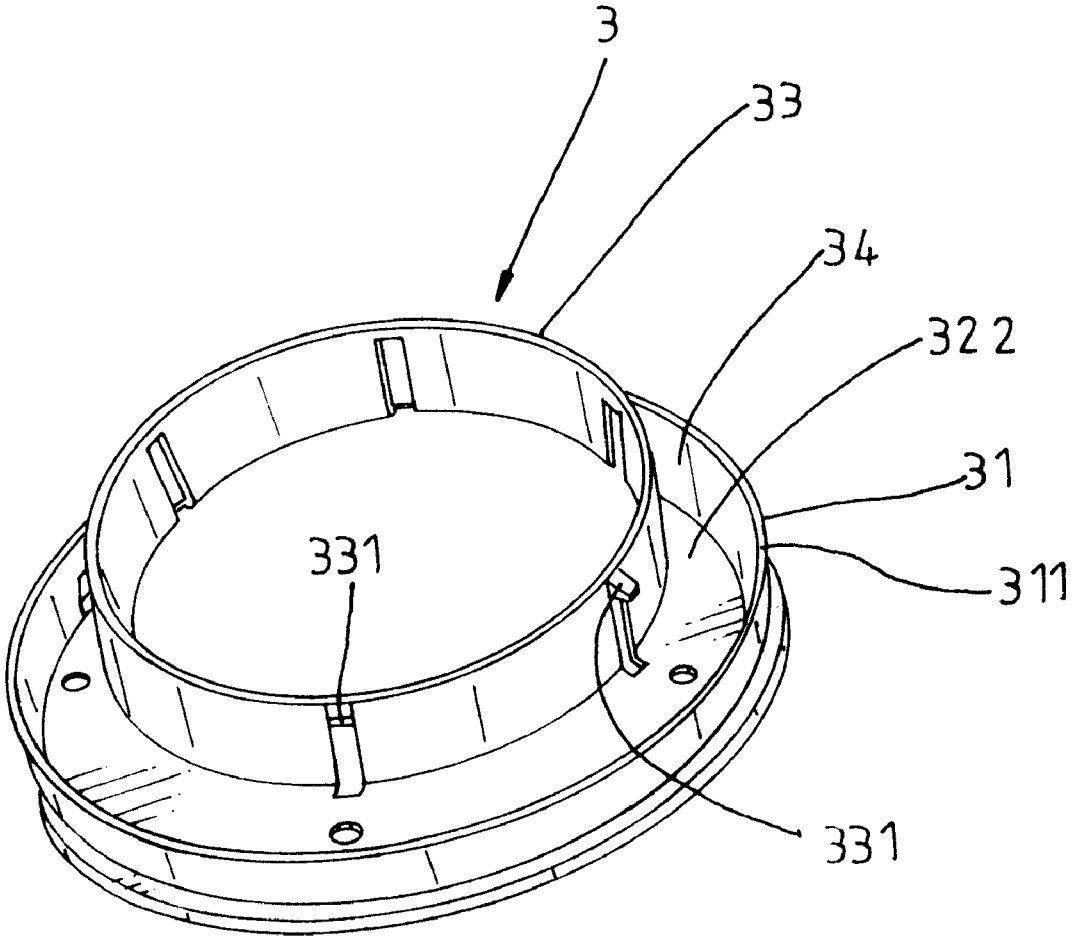
FIG. 8 is an oblique bottom view of the rotary carrier according to the present invention.

The rotary carrier 3, as shown in FIGS. 4 and 8, comprises an annular base 32, an inner vertical endless flange 33 raised from the bottom side wall 322 of the annular base 32 around the inner diameter thereof, an outer vertical endless flange 31 raised from the bottom side wall 322 of the annular bass 32 and spaced around the inner vertical endless flange 33, a bottom annular groove 34 defined between the inner vertical endless flange 33 and the outer vertical endless flange 31 which receives the ball bearing 4, a plurality of springy hooks 331 spaced around the inner vertical endless flange 33 and respectively hooked on the bottom edge 231 of the inner flange 23 of the seat holder 2, a plurality of pin holes 321 equiangularly spaced at the annular base 32 for the positioning of the seat 10, and a retaining holes 312 at the outer vertical endless flange 31 for engagement with the latch 25 at the seat holder 2. After installation of the rotary carrier 3 and the ball bearing 4 in the seat holder 2, the bottom edge 311 of the outer vertical endless flange 31 of the rotary carrier 3 is disposed in contact with the top side wall 22 of the seat holder 2, the bottom side wall 322 of the annular base 32 of the rotary carrier 3 is supported on the inner endless upright flange 21' of the seat holder 2, and the ball bearing 4 is received in the top annular groove 220 at the seat holder 2 and the bottom annular groove 34 at the rotary carrier 3.

Figure 2:
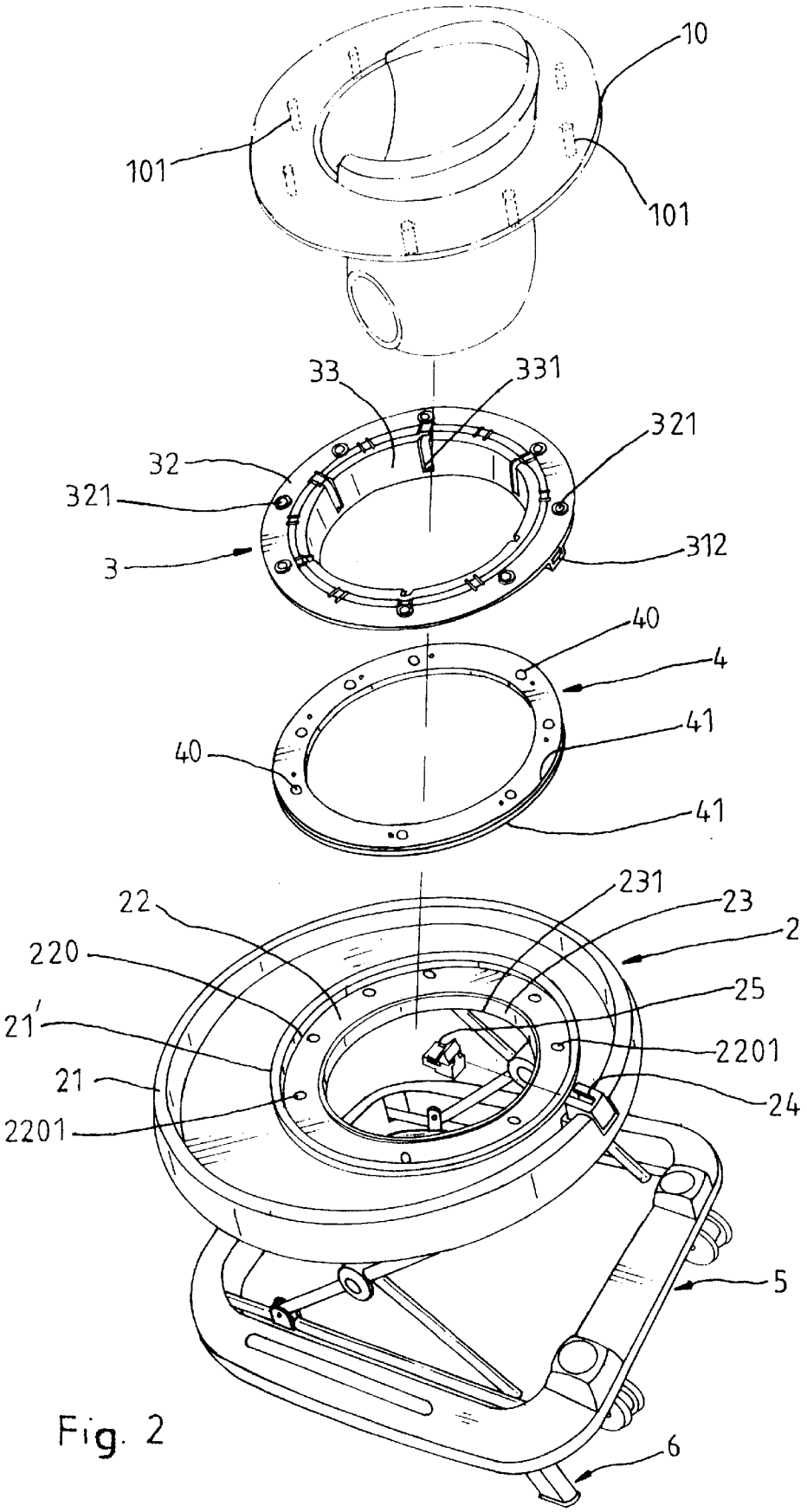
FIG. 2 is an exploded view of a baby walker according to the present invention.
Figure 3:
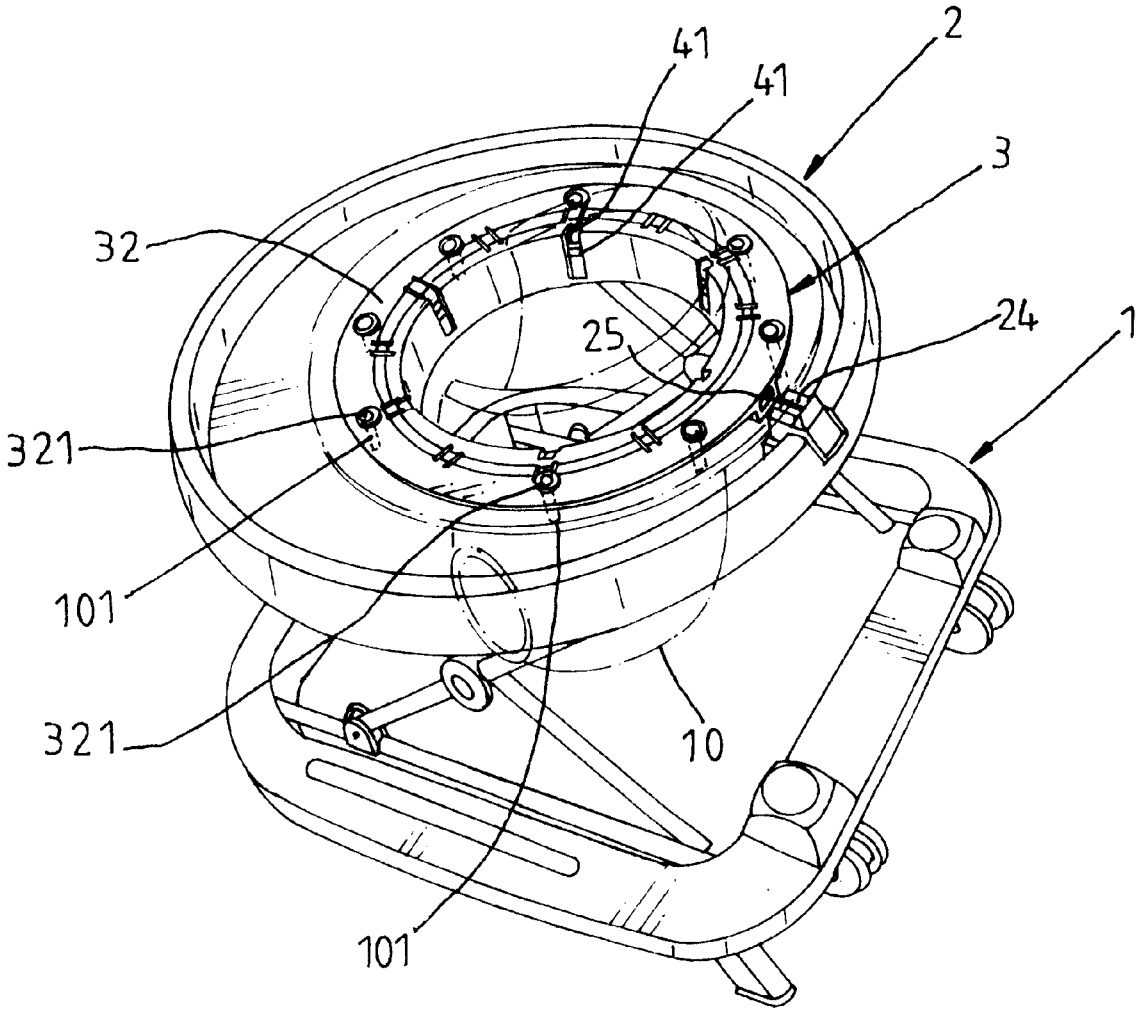
FIG. 3 is a perspective assembly view of the baby walker shown in FIG. 2.

The seat 10, as shown in FIGS. 2 and 3, comprises a plurality of positioning pins 101 respectively plugged into the pin holes 321 at the rotary carrier 3.

Figure 6:
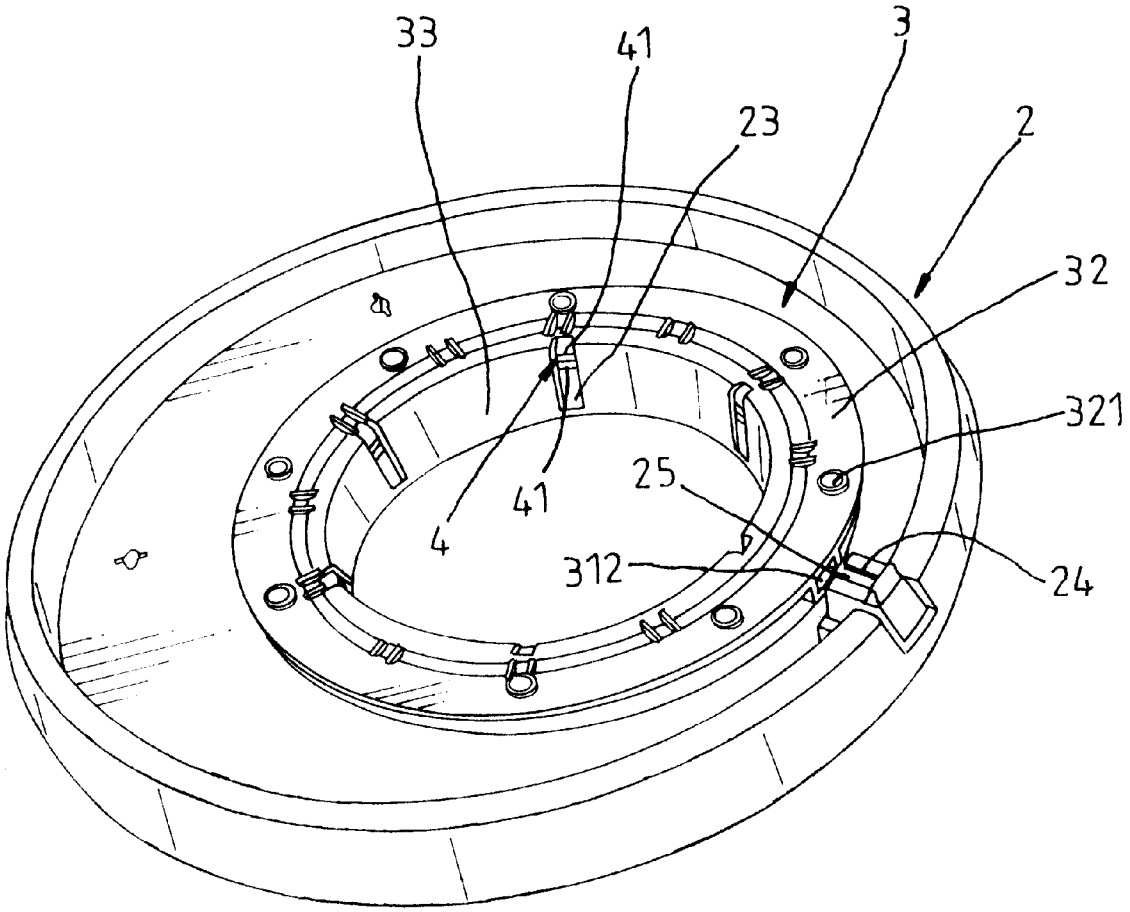
FIG. 6 is an assembly view of FIG. 5.
Figure 7:
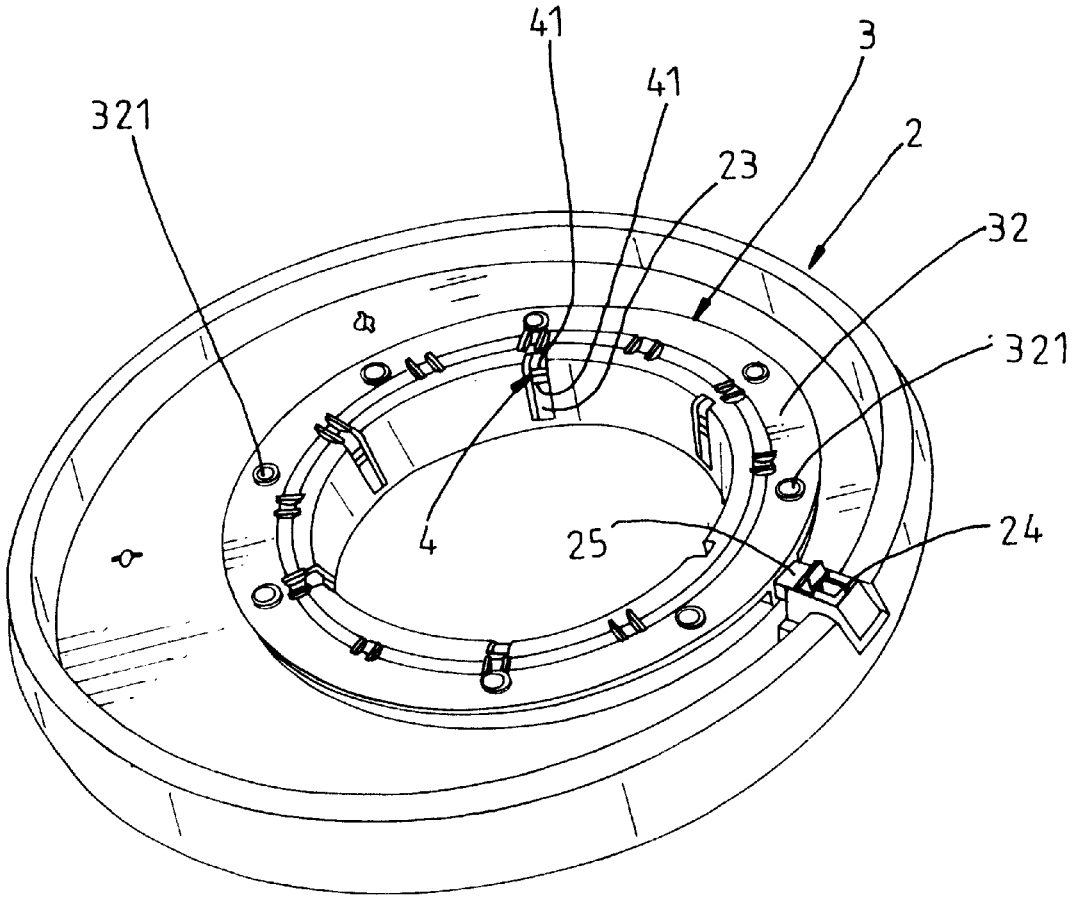
FIG. 7 is similar to FIG. 6 but showing the latch engaged into the retaining hole at the rotary carrier.

Referring to FIGS. 6 and 7 again, the latch 25 can be moved between the locking position where the latch 25 is engaged into the retaining hole 312 at the rotary carrier 3 to stop the rotary carrier 3 and the seat 10 from rotary motion relative to the seat holder 2 (see FIG. 7), and the unlocking position where the latch 25 is disengaged from the retaining hole 312 at the rotary carrier 3, for enabling the rotary carrier 3 and the seat 10 to be rotated on the seat holder 2 (see FIG. 6).

Referring to FIG. 2 again, the wheeled base 5 is equipped with a folding collapsible stand 6. The stand 6 can be extended out to support the baby walker 1 on the floor positively.

Furthermore, the ball bearing 4 and the rotary carrier 3 can be removed from the seat holder 2, enabling the seat 10 to be directly fastened to the seat holder 2 by plugging the positioning pins 101 of the seat 10 into the pin holes 2201 at the seat holder 2.

I claim:

1. A baby walker comprising a seat holder supported on a wheeled base thereof, and rotary carrier supported on said seat holder to hold a seat for enabling said seat to be rotated with said rotary carrier on said seat holder, wherein said seat holder comprises an inner flange around an inner diameter thereof, an outer endless upright flange and an inner endless upright flange concentrically raised from a top side wall thereof around said inner flange, and a top annular groove defined between said inner flange and said inner endless upright flange; said rotary carrier comprises an annular base supported on the inner endless upright flange at said seat holder, an inner vertical endless flange raised from said annular base at a bottom side around an inner diameter thereof, an outer vertical endless flange raised from said annular base and spaced around said inner vertical endless flange, a bottom annular groove defined between said inner vertical endless flange and said outer vertical endless flange, a plurality of springy hooks spaced around said inner vertical endless flange and respectively hooked on a bottom edge at the inner flange of said seat holder, and a plurality of pin holes equiangularly spaced at said annular base for the positioning of said seat.

2. The baby walker of claim 1 further comprising a ball bearing mounted in the top annular groove at said seat holder and the bottom annular groove at said rotary carrier to support said rotary carrier on said seat holder.

3. The baby walker of claim 2 wherein said ball bearing is comprised of two annular races connected in parallel, and a plurality of steel balls retained between said annular races, said annular races each comprising plurality of equiangularly spaced ball holes of diameter smaller than said steel balls for receiving said steel balls, a plurality of equiangularly locating pins, and a plurality of equiangularly spaced pin holes, the locating pins at one of said annular races being respectively fastened to the pin holes at the other of said annular races.

4. The baby walker of claim 1 wherein said rotary carrier comprises a retaining hole at said outer vertical endless flange, and said seat holder comprises a latch holder disposed inside said outer endless upright flange, and a latch moved in and out of said latch holder between a first position wherein said latch is engaged into the retaining hole at said rotary carrier to stop said rotary carrier from rotary motion relative to said seat holder, and a second position wherein said latch is disengaged from the retaining hole at said rotary carrier for enabling said rotary carrier to be rotated on said seat holder.

5. The baby walker of claim 1 wherein said seat holder further comprises a plurality of pin holes equiangularly spaced in said top annular groove for the positioning of said seat after removed of said rotary carrier from said seat holder.

* * * * *